United States Patent [19]

Ling

[11] Patent Number: 4,884,419

[45] Date of Patent: Dec. 5, 1989

[54] INTERLOCKABLE LOCK

[75] Inventor: Chong-Kuan Ling, Taipei, Taiwan

[73] Assignee: Sinox Company, Ltd., Taipei, Taiwan

[21] Appl. No.: 291,664

[22] Filed: Dec. 29, 1988

[51] Int. Cl.[4] ..... E05B 65/68

[52] U.S. Cl. ..... 70/4; 70/68; 70/312

[58] Field of Search ..... 70/68, 2, 3, 4, 5, 312; 24/381, 382, 386, 418, 419

[56] References Cited

U.S. PATENT DOCUMENTS

| | | | |
|---|---|---|---|
| 966,261 | 8/1910 | Stevens | 70/5 |
| 1,304,633 | 5/1919 | Volk | 70/4 |
| 3,597,945 | 8/1971 | Feinberg | 70/68 |
| 4,514,884 | 5/1985 | Kaneko | 70/68 |
| 4,756,173 | 7/1988 | Yang | 70/68 |
| 4,788,837 | 12/1988 | McFarlane | 70/5 |

*Primary Examiner*—Robert L: Wolfe

[57] ABSTRACT

An interlockable lock includes: a lock body pivotally secured to a first slider of a zipper fastener having a lock casing formed with a slot in in its bottom cover, a latch resiliently held in the lock body normally protruding toward the slot operatively engageable with a loop or hook formed on a second slider of the zipper fastener when rotating the lock body to allow the poking of the loop or hook into the bottom slot, and a longitudinal actuator depressible for retracting the latch to disengage from the second slider to open the lock. The longitudinal actuator may be locked by a locking mechanism formed in the lock body to retard a depression of the actuator to prevent a disengagement of the latch from the slider loop or hook.

12 Claims, 4 Drawing Sheets

INTERLOCKABLE LOCK

BACKGROUND OF THE INVENTION

Irving Feinberg disclosed a latching device and combination locking means in his U.S. Pat. No. 3,597,945 which includes a pair of pulls of the zipper sliders 28, 28' lockable between a body member A and a latch B when locking a hook 20 of the latch 8 with a transverse end 22 of a plug.C connected to the body member A. However Feinberg's device still has the following drawbacks:

1. The two pulls 30, 30' of the two sliders 28, 28' of slide fastener 26 are protected between the body member A and the latch B when locked, however, just being shielded at an outer brim thereof, so that a thief may easily bend the outer flange 56 of the latch B to unlock the two sliders, reducing its locking effect.

2. Since the two pulls 30, 30' of the two sliders 28, 28' are overlapped with each other to be locked at the stud 24 on the central body member A as shown in FIG. 2, the flexible strips of the slide fastener 26 can not be completely closed as obstructed by the outer edge of the body member A.

3. When opening the latch B as shown in FIG. 4 the end portion 50 is depressed (arrow x) to disengage the hook 20 from the transverse end 22, the depression of the end portion 50 is not comfortable on an ergonomics viewpoint, due to its low height limitation in consideration of its esthetic or design appearance.

4. The locking or opening procedures are very complex. For instance, the two pulls 30, 30' must be first precisely overlapped and jacketed on the stud 24 and then the latch B is closed on the body member A to shield the two pulls causing an inconvenient locking operation.

The present inventor has found the drawbacks of the Feinberg's lock and invented the present interlockable lock, with convenient operation, simple construction, and better security effect.

SUMMARY OF THE INVENTION

The object of the present invention is to provide a lock pivotally secured to a first base, having a latch resiliently retained within a slot formed through the lock and operatively engageable with a loop or hook formed on a second base, thereby forming an interlockable lock when the first base and the second base are respectively mounted on two members opened or closed with each other.

According to the present invention, there is provided an interlockable combination lock for a zipper fastener having the lock serving as a slider pull pivotally secured to a slider, with a latch operativlely engageable with an eyelet formed on the other slider of the zipper fastener to lock the two sliders.

DETAILED DESCRIPTION

Figure 1:
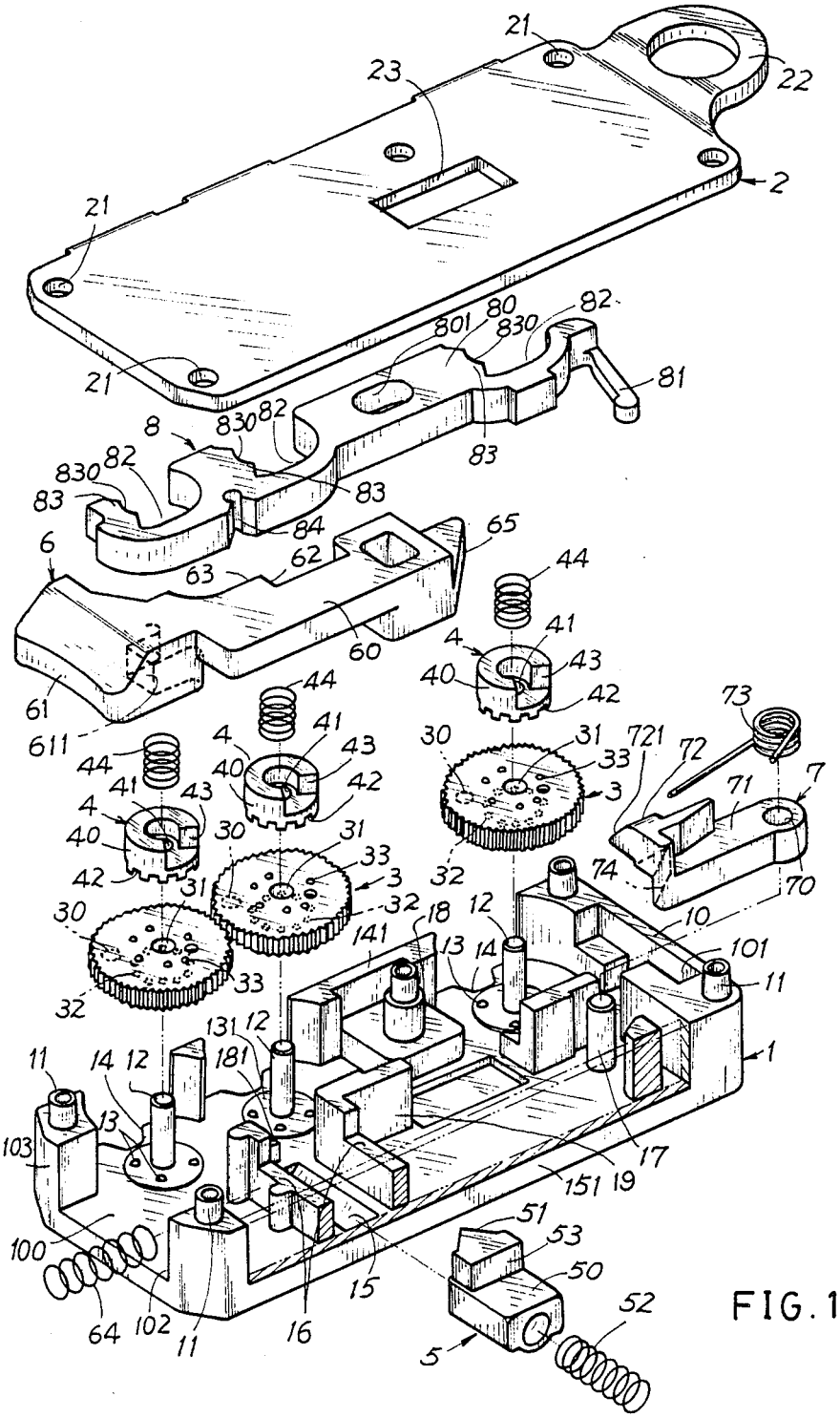
FIG. 1 is a perspective illustration showing all elements in construction of the present invention.
Figure 4:
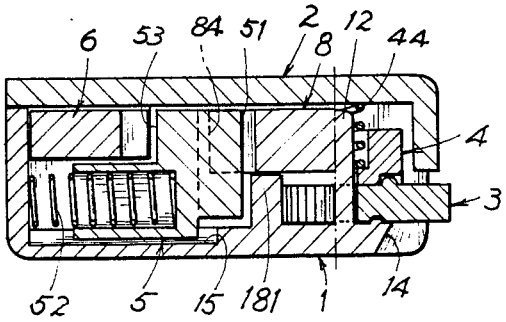
FIG. 4 is a cross sectional drawing of the present invention when viewed from I—I direction of FIG. 2.

As shown in FIGS. 1–7, the present invention comprises a lock body P pivotally secured to a zipper fastener 9a including: a first cover 1, a second cover 2 combinable with first cover 1 to form a lock casing 1, a plurality of dials 3, a plurality of sleeves 4 respectively engageable with the dials 3, a lateral detent means 5, a longitudinal actuator 6, an interlockable latching means 7, and a sliding coupler means 8.

The first cover 1 is generally formed as a rectangular shape composed of a first longitudinal side wall 141, a second longitudinal side wall 151 opposite to the first side wall 141, a bottom transverse side wall 10, and an upper transverse side wall 103 opposite to the bottom side wall 10. The first cover 1 includes: a plurality of stems 11 protruding upwardly from a base surface 100 of the first cover 1 engageable with a plurality of holes 21 formed in the second cover 2, a plurality of pivots 12 formed on the base surface 100 for pivotally mounting the plural dials 3 proximate to the first longitudinal side wall 141, a plurality of protrusions 13 radially disposed around each pivot 12 and formed on a protrusion platform 131 slightly protruding upwardly above the base surface 100 of the first cover 1, a plurality of notches 14 formed on the first longitudinal side wall 141 for revealing the numerals 30 formed on each dial 3, a spring socket 15 formed in the base surface 100 proximate to the second longitudinal side wall 151, a pair of lateral extensions 16 formed on the surface 100 proximate to the second side wall 151 for slidably moving the detent means 5 between the two extensions 16, a pivot stem 17 formed on the surface 100 proximate to the bottom side wall 10, and a stud 181 formed on the surface 100 near the first side wall 141 for slidably supporting the coupler means 8. The protrusion platform 131 is formed as a round disk having a perimeter samller than a perimeter circumferentially defined by the numerals 30 of each dial 3 so that the rotation of dial 3 will not cause wearing of its numeral 30 by the bottom surface 100.

The second cover 2 generally formed as rectangular shape corresponding to the first cover 1 includes a plurality of holes 21 formed in cover 1 engaged with the plural stems 11 to combine the first cover 1 for forming a lock casing, a connector 22 formed on a bottom side of the cover 2 pivotally secured to an eyelet extension 901 formed on a first slider 90 of a zipper fastener 9a used in the present invention, and a latching slot 23 formed in the cover 2 for operatively poking a second eyelet extension 91 of a second slider 9 of the zipper fastener 9a engageable with the latching means 7 for locking the present lock.

Each dial 3 is formed a plurality of recesses 32 on its bottom surface rotatively engageable with the plural protrusions 13 formed on the first cover 1, a central hole 31 for pivotally mounting each dial 3 on each pivot 12, and a plurality of protrusions 33 formed on an upper surface of the dial 3.

Each sleeve 4 is formed a central hole 41 for pivotally mounting the sleeve 4 on each pivot 12, a plurality of recesses 42 formed on a bottom surface of the sleeve 4 rotatably engageable with the plural protrusions 33 of each dial 3, a divergent notch 43 formed in an upper portion of the sleeve radially diverging outwardly, and a tensioning spring 44 retained between the sleeve 4 and the second cover 2 to resiliently engage the sleeve 4 on the dial 3.

The lateral detent means 5 includes: a flat portion 50 slidably laying on the surface 100 resiliently poking towards the sliding coupler means 8 as retained by the spring 52, a vertical portion 53 protruding upwardly from the flat portion 50, and a detent extension 51 selected from a wedge portion or a semi-circular portion tapered towards the coupler means 8 and protruding from the vertical portion 53.

The longitudinal actuator 6 includes: a longitudinal flat portion 60 slidably laid on the flat portion 50 of the lateral detent means 5 and movably defined between the second longitudinal side wall 151 and a central extension 19 formed on the first cover 1, a depression plate 61 pertaining the longitudinal flat portion 60 protruding outwardly through an upper opening 102 formed in the upper side wall 103 having a socket 611 formed in the plate 61 for retaining a restoring spring 64 between the socket 611 and one said lateral extension 16, a recess portion 62 recessed from a flat side wall 63 towards the second side wall 151, the restoring spring 64 normally tensioning the depression plate 61 outwardly, and an angled block 65 formed on a bottom portion of the flat portion 60 having a sloping surface tapered towards the first side wall 141 and the bottom side wall 10. The depression plate 61 is recessed to form a finger-tip recess portion adapted for a finger's depression by a user.

Figure 5:
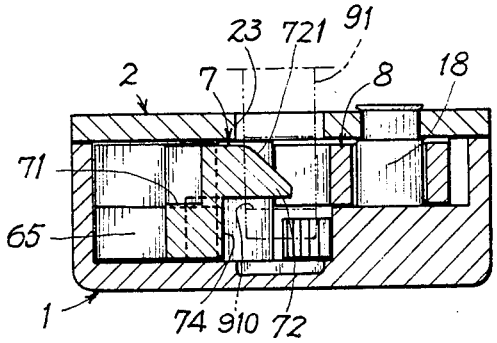
FIG. 5 is a cross sectional drawing of the present invention when viewed from II—II direction of FIG. 3.

The interlockable latching means 7 includes: a lever 71 having a pivot hole 70 pivotally securing the lever 71 on the stem 17 and having a restoring spring 73 resiliently biasing the lever 71 towards the latching slot 23, a latch 72 formed on a side portion of the lever 71 projecting towards the slot 23 having a sloping surface 721 tangentially depressible by the second eyelet extension 91 as shown in FIG. 5 when the latch 72 is operatively engaged with the eyelet 910 formed in the second extension 91 of the second slider 9, and an angled block 74 formed under the latch and on a front portion of the lever 71 having a sloping surface tapered towards the second longitudinal side wall 151 and tangentially depressible by the sloping surface of the angled block 65 to retract the latch 72 towards the second side wall 151 from the slot 23. Regardless of a locking or unlocking of the actuator 6, the block 74 is depressible by the slider extension 91 when closing the lock body P towards the second slider 9.

Figure 3:
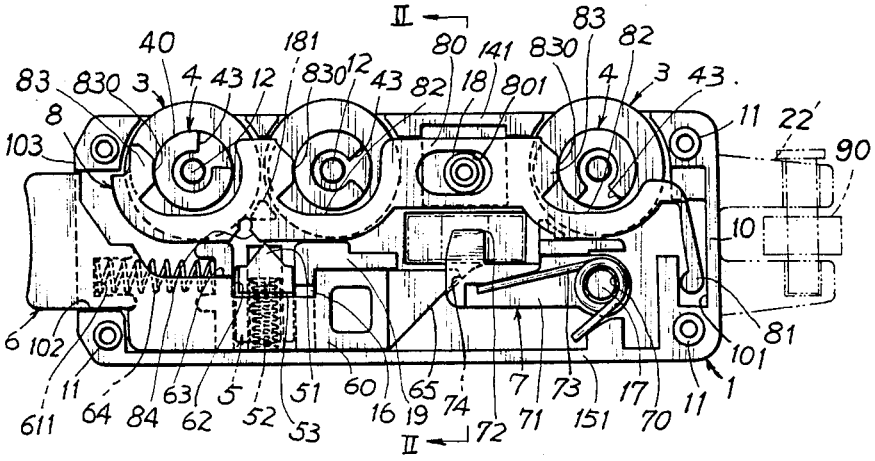
FIG. 3 is an illustration of the present invention when locked.

The sliding coupler means 8 generally formed as an elongate plate 80 includes: a spring plate 81 formed on a bottom portion of the plate 80 embedded in a bottom socket 101 proximate to the bottom side wall 10 normally tensioning the elongate plate 80 towards the bottom side wall 10 and having a central slot 801 for reciprocativley mounting the plate 80 on a guide rod 18 formed on the surface 100 proximate to the first side wall 141, a plurality of sleeve holes 82 formed in the plate 80 each hole 82 having a taper extension 83 formed on an upper perimeter of the hole 82 operativley engageable with the divergent notch 43 of the sleeve 4 having an arcuate surface 830 operativley engageable with a perimeter 40 of the sleeve 4 as shown in FIG. 3, and a side notch 84 formed on a side wall of the plate 80 which notch 84 may be shaped as a triangular or semi-circular shape operatively engageable with the detent extension such as a wedge portion 51 of the detent means 5.

Figure 10:
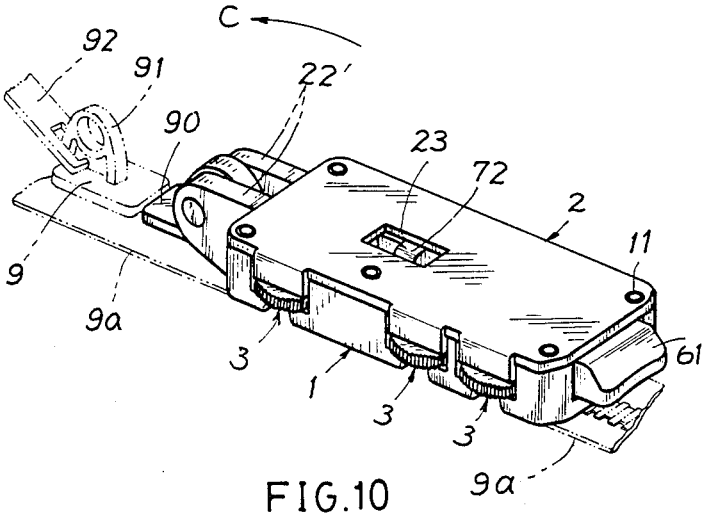
FIG. 10 is an illustration showing a lock body of the present invention having brackets pivotally secured to a slider of a zipper fastener.

The connector 22 can be a ring type as shown in FIG. 1 or can be modified as two brackets 22' protruding rearwardly as shown in FIG. 3 and FIG. 10 to be pivotally secured to a slider 90 of a zipper fastener 9*a*. The spring plate 81 may be integrally formed with the elongate plate 80 by a plastic molding process.

Figure 6:
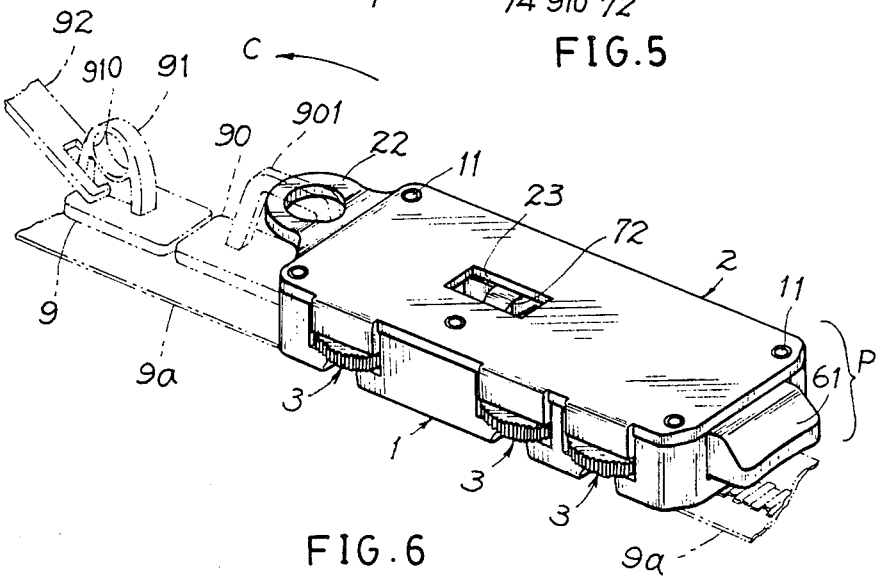
FIG. 6 is an illustration showing an opening lock of the present invention used for a zipper fastener.
Figure 7:
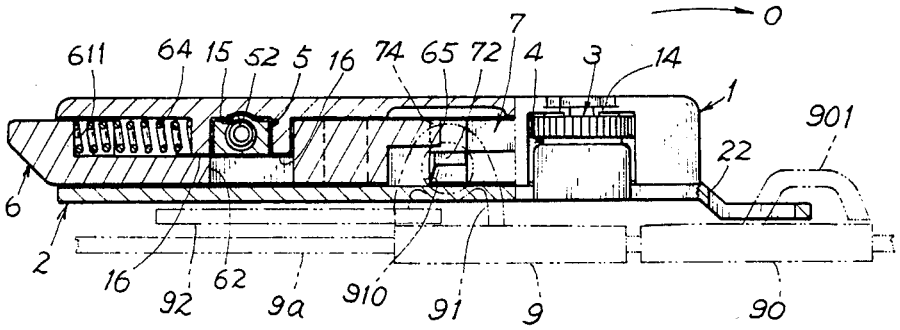
FIG. 7 is an illustration showing a locking state of the present invention.

When it is intended to lock the present invention, two pulls 92, P of the two sliders 9, 90 of the zipper fastener 9*a* are pulled together as shown in FIG. 6 as the puller served by the lock body P of the present invention is pivotted in a direction C from FIG. 6 to FIG. 7 to allow the latch 72 of the interlockable latching means 7 to engage the eyelet 910 of the second slider 9 of the zipper fastener 9*a*. The dials 3 are also rotated to a locking combination as shown in FIG. 3, in which the taper extensions 83 of the coupler means 8 are thrusted upwardly by the divergent notches 43 of the sleeves 4 so that the coupler means 8 will be pushed upwardly (leftwardly) from FIG. 2 to FIG. 3 and the side notch 84 of coupler means 8 will thrust the wedge portion 51 to retract the detent means 5 to allow its vertical portion 53 to engage the recess portion 62 of the longitudinal actuator 6 as shown in FIG. 3, thereby obstructing a rightward depression of the depression plate 61 for locking the present lock.

Figure 2:
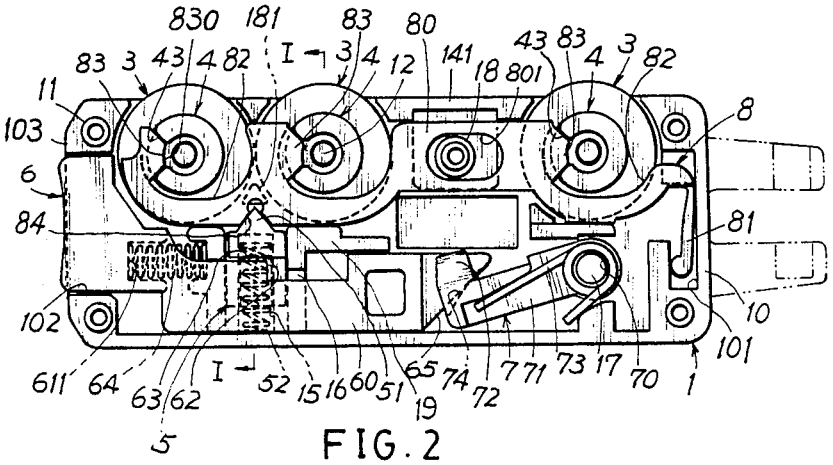
FIG. 2 is an illustration showing an opening state of the present invention when removing a second cover from an assembled lock.

For opening the present lock as shown in direction O in FIG. 7, the dials are rotated to their opening state to allow the sleeve notches 43 to engage the extensions 83 of the coupler means 8 as shown in FIG. 2 whereby the wedge portion 51 is restored by the spring 52 to engage the side notch 84, but to disengage the vertical portion 53 from the recess portion 62 of the actuator 6, and upon a depression on the depression plate 61, the angled block 65 will tangentially push the angled block 74 of the latching means 7 towards the second side wall 151 to retract the latch 72 to disengage from the second eyelet extension 91 of the second slider for opening the lock.

If it is intended to reset a new combination, the depression plate 61 is depressed at its opening condition as shown in FIG. 2 to allow the side wall 63 of the actuator 6 retarding the vertical portion 53 of the detent means to engage the wedge portion 51 with the side notch 84 of the coupler means 8, whereby the sleeve 4 are locked due to the engagement of the extensions 83 with the sleeve notches 43, and the dials 3 can be free rotated for changing a new combination for opening the lock.

Therefore, the present invention can be utilized on a luggage or case in which a zipper fastener provided with the present lock body P is installed.

Figure 8:
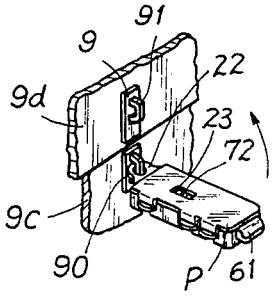
FIG. 8 shows another preferred embodiment of the present invention.
Figure 9:
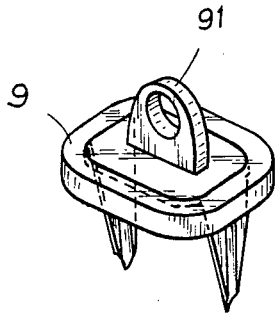
FIG. 9 shows a second base and a loop in accordance with the present invention.

As shown in FIG. 8, the present invention can be modified to comprise: a lock body P as aforesaid pivotally secured to a first base 90 mounted on a first member 9*c* such as a door frame or a luggage housing or the like an operatively locked by engaging the latch 72 within the slot 23 with an eyelet 91 of a second base 9 mounted on a second member 9*d* such as a door or a luggage cover. The second base 9 may be fixed on a door or luggage cover by protruding several acute protrusions downwardly into the second member 9*d*, having the loop 91 protruding upwardly through a central slot of the base 9 when the loop 91 is formed on a basic plate embedded under the base 9 as shown in FIG. 9.

The present invention is superior to the Feinberg's device with the following advantages:

1. The lock body P directly serves as a slider pull which can be pulled together with another pull 92 of another slider and quickly locked together for convenient locking operation.

2. The latch 72 is concealedly locked with a slider eyelet, which is difficult to be opened for better security effect. Also, when a thief tries to open the lock by touch feeling when depressing the actuator 6 and rotating the dial 3 and sleeves 4, the longitudinal actuator 6 is first obstracted by the lateral detent means 5 so that the thief's depression force can not be transmitted to the dial side, unable to open the dials as sensed by his feeling.

3. The two sliders 9, 90 of the zipper fastener 9*a* can be pulled as close as possibly to remain no aperture therebetween for completely locking a zipper fastener, especially improved over Feinberg's prior art as shown in FIG. 2.

4. The depression of the depression plate 61 is a linear action and can be operated more comfortably on an ergonomic viewpoint.

I claim:

1. An interlockable lock comprising:

a lock body pivotally secured to a first slider of a zipper fastener and having a latch operatively engageable with an eyelet formed in a second slider of the zipper fastener for locking the lock body on the second slider for closing two sliders of the zipper fastener, the lock body comprising:

a first cover generally formed as a rectangular shape composed of a first longitudinal side wall, a second longitudinal side wall opposite to said first side wall, a bottom transverse side wall formed on a bottom portion between the first and second side walls, and an upper transverse side wall formed on an upper portion between the first and second side walls opposite to said bottom side wall;

a second cover having a rectangular shape corresponding to said first cover and combinable with said first cover to form a lock casing having a latching slot formed therein;

a plurality of dials pivotally mounted on said first cover proximate to said first longitudinal side wall each sleeve having a divergent notch formed therein;

a plurality of sleeves resiliently retained on said dials each said sleeve rotatably engageable with each said dial;

a lateral detent means transversely formed on said first cover resiliently tensioned against said second longitudinal said wall towards the first longitudinal side wall;

a longitudinal actuator slidably formed on said detent means proximate to said second longitudinal side wall having a depression plate resiliently protruding outwardly from said upper side wall;

an interlockable latching means having the latch normally biased by a restoring spring to poke into the slot in said second cover for operatively engaging the eyelet formed in said second slider of the zipper fastener; and a sliding coupler means generally formed as an elongate plate having a plurality of sleeve holes each sleeve hole having a taper extension engageable with said divergent notch of each said sleeve, said elongate plate normally resiliently retained towards said bottom side wall having a side notch operatively engageable with a detent extension of said detent means; said longitudinal actuator having a recess portion formed on a side wall thereof operatively engaged with said detent means for preventing the depression of said depression plate for locking said lock body, when the coupler means disengages from the sleeves to disengage the side notch of the coupler means from the detent extension of the detent means; said longitudinal actuator having a bottom angled block tangentially biasing another angled block formed on said latching means to retract said latch to disengage from the second slider for opening the lock.

2. An interlockable lock according to claim 1, wherein said lateral detent means includes a flat portion movably guided between two lateral extensions transversely formed on a base surface of said first cover, a vertical portion protruding upwardly from said flat portion operatively engaged with said recess portion of said longitudinal actuator, and a detent extension selected from a wedge portion or a semi-circular portion tapered towards said sliding coupler means protruding from said vertical portion, and a first restoring spring tensioning said detent means towards said coupler means.

3. An interlockable lock according to claim 1, wherein said longitudinal actuator generally formed as a flat plate slidably laid on said flat portion of said detent means includes said depression plate reformed with a socket for storing a tensioning spring, retained on one said lateral extension of said detent means, for tensioning said depression plate outwardly through an opening in said upper side wall, and the angled block formed on a bottom portion thereof having a first sloping surface tapered towards said first longitudinal side wall and said bottom transverse side wall.

4. An interlockable lock according to claim 1, wherein said interlockable latching means includes said angled block formed under said latch having a second sloping surface tapered towards said second longitudinal side wall, and a second restoring spring resiliently biasing a lever of said latching means towards said slot of said second cover, said lever being pivotally mounted on a stem on said first cover.

5. An interlockable lock according to claim 1, wherein said sliding coupler means includes an elongate plate having a spring plate integrally formed on its bottom portion embedded in a bottom socket formed in the bottom side wall normally tensioning said elongate plate towards said bottom side wall, a central slot formed in said elongate plate for slidably mounting said elongate plate on a guide rod formed on said first cover, and said side notch formed as a triangular or a semi-circular shape diverging outwardly towards and engageable with said wedge portion of said detent means.

6. An interlockable lock according to claim 5, wherein a taper extension of said sliding coupler means engageable with said divergent notch of said sleeve has an arcuate surface formed on a lower portion of the taper extension operatively engageable with a perimeter of said sleeve.

7. An interlockable lock according to claim 4, wherein said latch of said interlockable latching means has a sloping surface tangentially depressible by an eyelet extension of said second slider of the zipper fastener.

8. An interlockable lock according to claim 3, wherein said longitudinal actuator is movably defined between a central extension formed on said first side wall and said second longitudinal side wall, having a finger-tip recess portion formed in said depression plate adapted for a finger depression operation by a user.

9. An interlockable lock according to claim 1, wherein said second cover has a connector formed on its bottom portion pivotally secured to an eyelet extension formed on said first slider.

10. A lock according to claim 1, wherein each said dial pivotally mounted on each pivot formed on the first cover is formed with a plurality of recesses in its bottom surface rotatively engageable with a plurality of protrusions radially disposed around each said pivot, said protrusions of said dial being formed on a protrusion platform shaped as a round disk slightly positioned above a bottom surface of the first cover, said protrusion platform having a perimeter smaller than a perimeter circumferentially defined by a plurality of numerals formed on the bottom side of the dial to prevent wearing of the dial numerals by the bottom surface of the first cover.

11. An interlockable lock comprising:

a lock body pivotally secured to a first base mounted on a first member and having a latch operatively engageable with an eyelet formed in a second base mounted on a second member for locking the first member with the second member, the lock body comprising:

a first cover generally formed as a rectangular shape composed of a first longitudinal side wall, a second longitudinal side wall opposite to said first side wall, a bottom transverse side wall formed on a bottom portion between the first and second side walls, and an upper transverse side wall formed on an upper portion between the first and second side walls opposite to said bottom side wall;

a second cover having a rectangular shape corresponding to said first cover and combinable with said first cover to form a lock casing having a latching slot formed therein;

a plurality of dials pivotally mounted on said first cover proximate to said first longitudinal side wall each sleeve having a divergent notch formed therein;

a plurality of sleeves resiliently retained on said dials each said sleeve rotatably engageable with each said dial;

a lateral detent means transversely formed on said first cover resiliently tensioned against said second longitudinal side wall towards said first longitudinal side wall;

a longitudinal actuator slidably formed on said detent means proximate to said second longitudinal side wall having a depression plate resiliently protruding outwardly from said upper side wall;

an interlockable latching means having the latch normally biased by a restoring spring to poke into the slot in said second cover for operatively engaging the eyelet formed in said second base of the second member; and a sliding coupler means generally formed as an elongate plate having a plurality of sleeve holes each sleeve hole having a taper extension engageable with said divergent notch of each said sleeve, said elongate plate normally resiliently retained towards said bottom side wall having a side notch operatively engageable with a detent extension of said detent means; said longitudinal actuator having a recess portion formed on a side wall thereof operatively engaged with said detent means for preventing the depression of said depression plate for locking said lock body, when the coupler means disengages from the sleeves to disengage the side notch of the coupler means from the detent extension of the detent means; said longitudinal actuator having a bottom angled block tangentially biasing another angled block formed on said latching means to retract said latch to disengage from the second base for opening the lock.

12. An interlockable lock according to claim 11, wherein said first member is selected from a door frame, a luggage casing or a container; and said second member is selected from a door, a luggage cover or a container cover respectively corresponding to said first member.

* * * * *